US006176196B1

(12) United States Patent
Halter

(10) Patent No.: US 6,176,196 B1
(45) Date of Patent: Jan. 23, 2001

(54) BOAT BOTTOM HULL DESIGN

(76) Inventor: Harold P. Halter, 754 Crystal St., New Orleans, LA (US) 70124

( * ) Notice: Under 35 U.S.C. 154(b), the term of this patent shall be extended for 0 days.

(21) Appl. No.: 08/943,364

(22) Filed: Oct. 3, 1997

Related U.S. Application Data

(60) Provisional application No. 60/027,316, filed on Oct. 3, 1996.

(51) Int. Cl.[7] ..... B63B 1/00
(52) U.S. Cl. ..... 114/271; 114/291
(58) Field of Search ..... 114/56, 65 R, 114/271, 283, 288, 291, 56.1

(56) References Cited

U.S. PATENT DOCUMENTS 3,698,342 * 10/1972 Jackson ..... 114/291
4,128,072 * 12/1978 Wood, Jr. ..... 114/291
4,409,922 * 10/1983 Mambretti ..... 114/283

* cited by examiner

*Primary Examiner*—Jesus D. Sotelo

(74) *Attorney, Agent, or Firm*—C. Emmett Pugh; Pugh/Associates

(57) ABSTRACT

A hull design with a maximally narrowed lower hull comprised of a stepped inboard chine and a concave centerline section resulting in the center of buoyancy and center of gravity preferably being in the same longitudinal position. The narrow lower hull optimally reduces the wetted surface area required, thereby reducing power requirements, fuel costs, and increasing speed potential. Exemplary dimensions for a forty-five (45') foot hull are disclosed. The hull has a much deeper transverse step (note FIG. 3) to more effectively exploit the potential advantages of internal chines and lifting strakes, which deeper transverse step effectively achieves a bi-modal hull form—displacement and planing. The hull form consistently achieves and maintains the flow separation needed to assure the low surface area needed for minimum planing resistance and minimum sea wave impact acceleration. Additionally, the hull's convex curvature in the narrow planing region of the hull shifts the center of dynamic pressure forward, providing a more balanced acceleration, with less extreme boat attitudes, in the transition from displacement to planing mode, as well as when operating at steady speeds over the entire speed range.

6 Claims, 6 Drawing Sheets

BOAT BOTTOM HULL DESIGN

RELATED APPLICATION

This application is based on provisional patent application Serial No. 60/027,316, filed Oct. 3, 1996 entitled "Boat Bottom Hull Design", the priority benefit of which is claimed herein.

TECHNICAL FIELD

The present invention relates to a planing boat hull design, and more particularly to a boat hull bottom design that provides improved performance, from the standpoints of both (1) higher speed for a given installed power, and (2) reduced impact acceleration in waves for a given speed.

BACKGROUND ART

Planing refers to the hydrodynamic process whereas, on increasing speed, the boat is lifted up relative to the water surface by dynamic pressure acting over the surface of the boat hull bottom. This dynamic pressure is an increasing function of boat speed. At rest, the boat is supported (floats) by pressure provided by hydrostatics at zero speed, resulting in the boat being positioned deeper in the water, displacing a larger water volume than in planning.

Conflicting conditions of operation therefore exist with the typical planning craft:

1. displacement (low speed) mode, requiring relatively large displaced volume and larger wetted surface area, and
2. planing (high speed) mode, requiring relatively small displacement and smaller wetted surface area.

The conflict is that, in order to have the area needed for displacement operation, excessive area and its accompanying excessive drag tend to occur in high speed planing operation.

Modern planing craft resolve this conflict to some degree by the use of stepped sterns, lifting strakes, internal chines, and/or combinations thereof. [Note FIG. 1 ("Prior Art").] All three of the hull form modifications shown function to separate the flow in steady planing (as well as in seaway slamming) to produce a smaller area for reduced planing resistance (and impact acceleration).

In the current state-of-the-art of internal chines and lifting strakes, relatively small "flow trips" are used that are often not effective. The main shortcoming is that the flow separated at the chine, or strake, can reattach, and thus the prior art has not consistently achieved the relatively low wetted surface area needed for optimum planing performance. [Note FIG. 2 ("Prior Art").]

The present invention over-comes the prior art deficiencies.

GENERAL SUMMARY DISCUSSION OF INVENTION

The present invention over-comes the prior art's deficiencies by, in part, using a boat bottom hull with a much deeper, transverse step, as shown in FIG. 3 in comparison to, for example, FIG. 2, to more effectively exploit the potential advantages of internal chines and lifting strakes. Thus, in the present invention, the hull bottom has a much deeper transverse step which effectively achieves a bi-modal hull form—displacement and planing.

The hull form of the present invention consistently achieves and maintains the flow separation needed to assure the relatively low surface area needed for minimum planing resistance and minimum sea wave impact acceleration. Comparative, specific analyzes, comparing the present invention's approaches to those of the prior art, are presented below, toward the end of the description portion of this specification.

In addition and in combination with the deeper transverse step, the concave curvature of the narrow planing region of the hull shifts the center of dynamic pressure forward and provides a more balanced acceleration, with less extreme boat attitudes, in the transition from displacement to planing mode, as well as when operating at steady speeds over the entire speed range.

It is thus an object of the invention to provide a planing boat hull that effectively achieves a bi-modal hull form—displacement and planing—by using a much deeper transverse step than that of the prior art.

It is a further object of the invention to provide a planing boat hull that consistently achieves and maintains the flow separation needed to assure the relatively low surface area needed for minimum planing resistance and minimum sea wave impact acceleration.

It is a further object of the invention to provide a planing boat hull that utilizes the concave curvature of the narrow planing region of the hull to shift the center of dynamic pressure forward, providing a more balanced acceleration, with less extreme boat attitudes, in the transition from displacement to planing mode, as well as when operating at steady speeds over the entire speed range.

It is a secondary object of the invention to provide a planing boat hull with a center of buoyancy and center of gravity in the same longitudinal position or as close thereto as practical.

It is also a secondary object of the invention to provide a boat hull that is able to ride on less wetted surface, thereby reducing power requirements, fuel costs, and increasing potential speed.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODES FOR CARRYING OUT THE INVENTION

Figure 3:
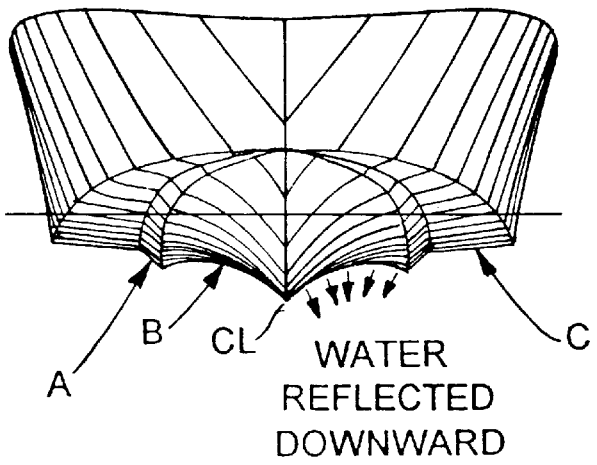
FIG. 3 is a front body view of an exemplary, currently preferred embodiment of the boat hull of the present invention.

As shown in FIG. 3, the exemplary boat hull design of the present invention is comprised of three essential features—a stepped inboard chine A, a concave centerline section B, and an outboard flat of the bottom C.

The stepped inboard chine A directs the water away from the hull and is considerably larger or deeper than conventional chines. The depth of the chine ensures that the outboard flat of the bottom generally remains out of the water.

The concave centerline section B directs the water both away and down from the hull, causing an upward resultant force. The arrows in FIG. 3 indicate the direction of the deflected water which is normal to the surface of the hull. The result is to increase the upward force which supports the hull. This allows the hull to be supported by an even smaller area and therefore reduces the drag, while allowing the boat to plane at slower speeds.

The outboard flat of the bottom C acts as reserve buoyancy at lower speeds and gives transverse stability in a seaway. It also has a small angle from the horizontal of plus or minus five to fifteen (±5° to 15°) degrees, to avoid slamming.

Reserve buoyancy is the volume of the hull not normally immersed which, when immersed, tends to keep the vessel afloat and balanced. In rough water the boat can still plane, but it rides on both the lower hull below the chine and the outboard flat of bottom.

When planing, the hull of the invention rides on the lower narrow portion of the hull comprised of the stepped inboard chine A and the concave centerline section B. The narrower hull also allows better placement of inboard equipment so the boat can be further balanced at all speeds.

The chine ranges in width between one-half (½) to one-fourth (¼) of the underwater beam of the hull and functions best with a mild angle of about seven to fifteen (~7°–15°) degrees. The slope of the angle may be positive or negative. The chine develops its full width between one-fourth (¼) and one-third (⅓) of the boat length aft from the bow.

Transition from the chine to the bottom of the hull is a pronounced step downward at approximately forty-five (45°) degrees toward the centerline section. An exemplary depth of the chine for a forty-five (45') foot boat has a drop of about five (5") inches to hull bottom. The angle of the transition can be varied all the way to vertical to adjust how the boat tracks in a turn. The downward step is intended to be large enough to raise the hull chine out of, and clear of, the water.

The concave bottom has a moderate "VEE" forward transitioning into an increasing concave section beginning approximately one-third (⅓) of the boat's length aft of the bow. The concavity is just enough at the outboard edge to direct the deflected water downward, and not just outboard.

Finally, the one-half (½) angle of the transom should not be greater than twenty-one (21°) degrees and ideally is between ten and seventeen (10° and 17°) degrees. Lower angles give higher speeds but give a harsher ride.

The above details are, of course, merely exemplary of the currently preferred embodiment for a forty-five (45') foot hull and is subject to great variation.

Figure 8:
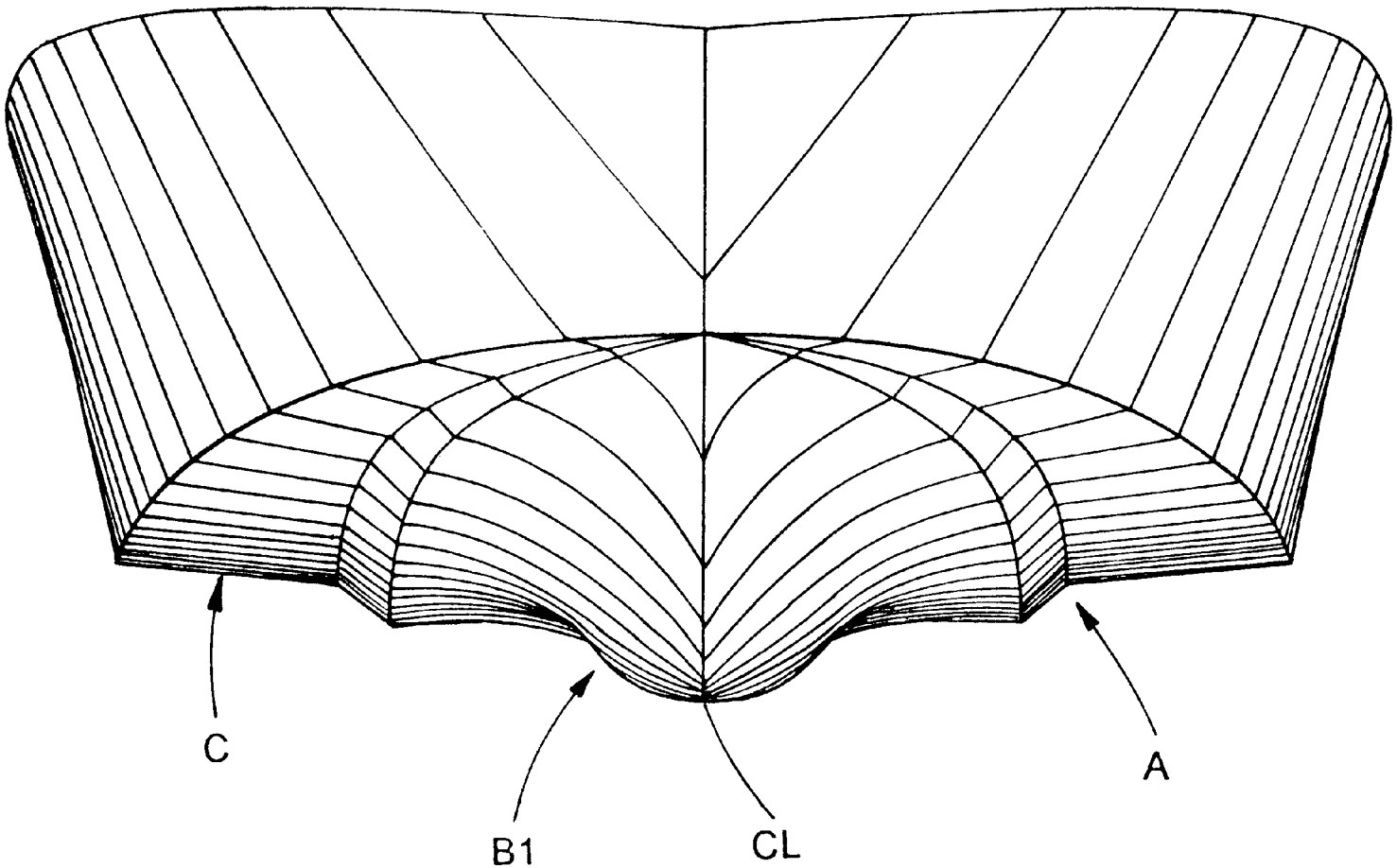
FIG. 8 is a front body view of an alternate embodiment of the boat hull design of the present invention.

An alternate embodiment is shown in FIG. 8 which includes a rounded hull centerline section B1 which can accommodates, for example, water jets. The hull centerline section is rounded in a convex shape, which results in a flattened 'S-like' shape, which directs water down as previously described for the other embodiment, allowing a free flow of water for the input of, for example, water jets. The rest of the hull is the same as the embodiment of FIG. 3 and will not be repeated here for brevity's sake.

Figure 4:
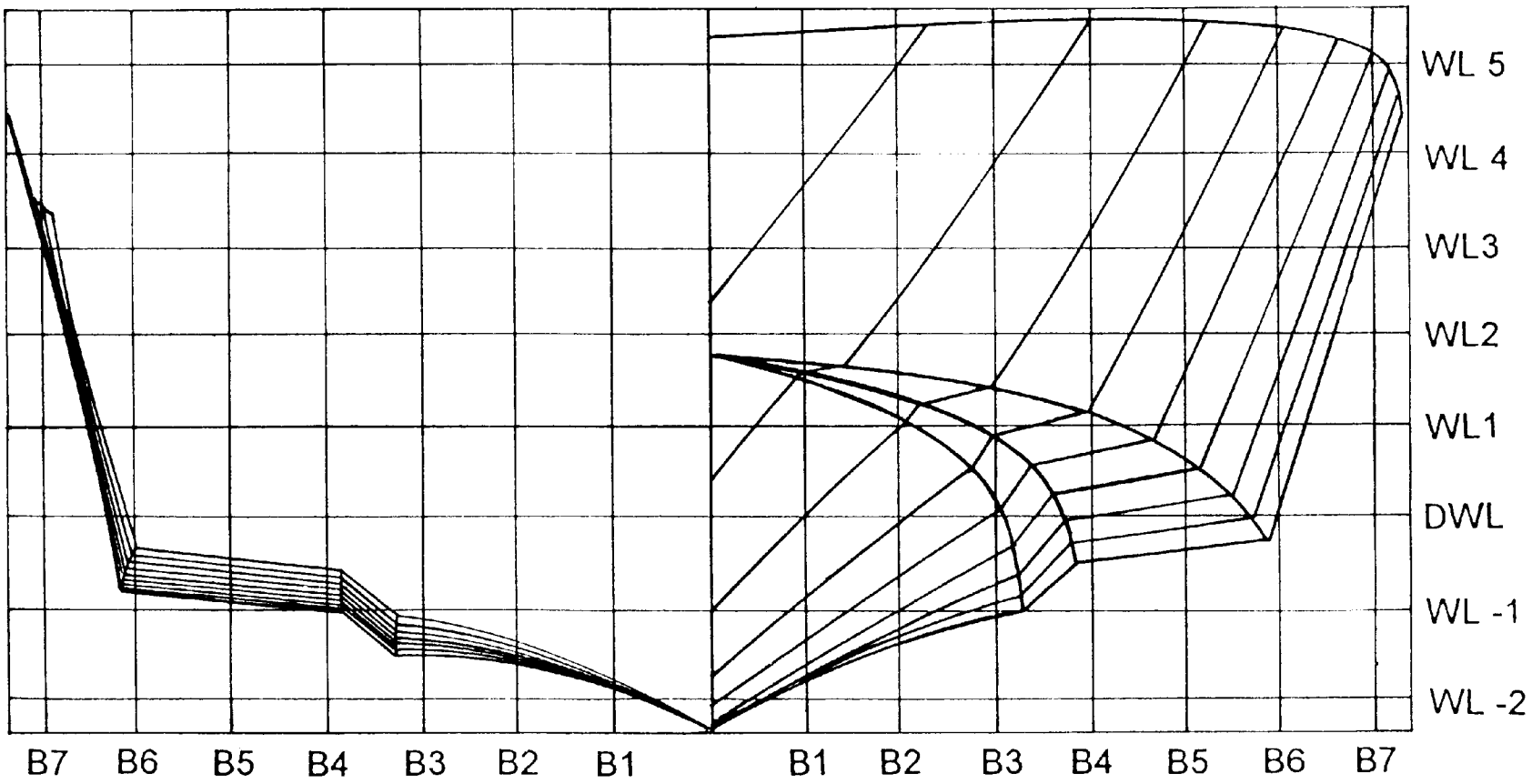
FIG. 4 is a further, partial, graphical, plan front view of the boat hull of FIG. 3 to be referenced along with Tables 1 through 19 referenced in the specification hereof.
Figure 5:
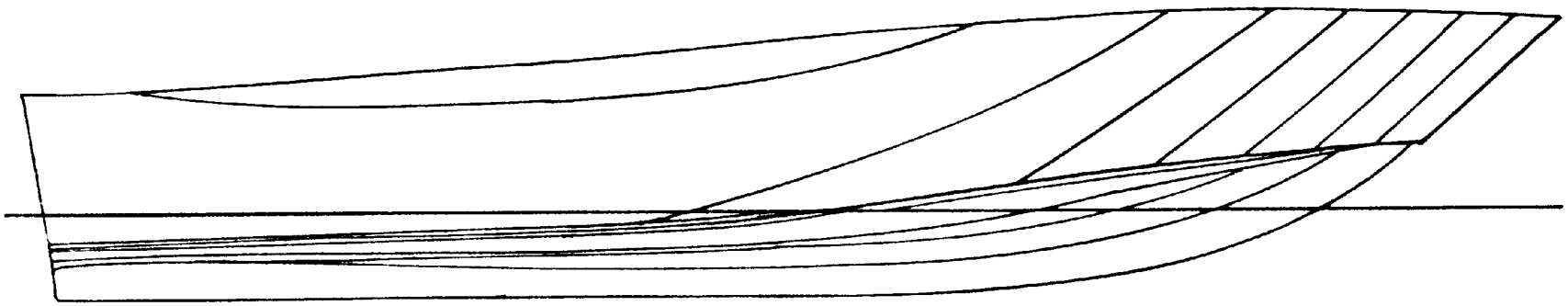
FIG. 5 is a starboard profile view of the boat hull of FIG. 3.
Figure 6:
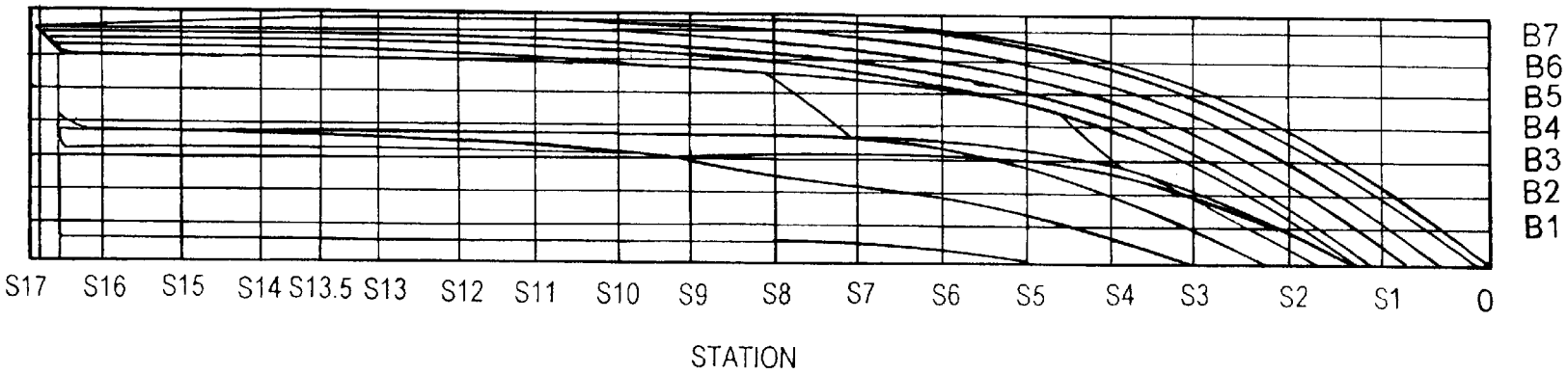
FIG. 6 is a plan, half-bottom view, in graphical form, of the boat hull of FIG. 3, which is symmetrical about its centerline, to be referenced along with Tables 1 through 19.
Figure 7:
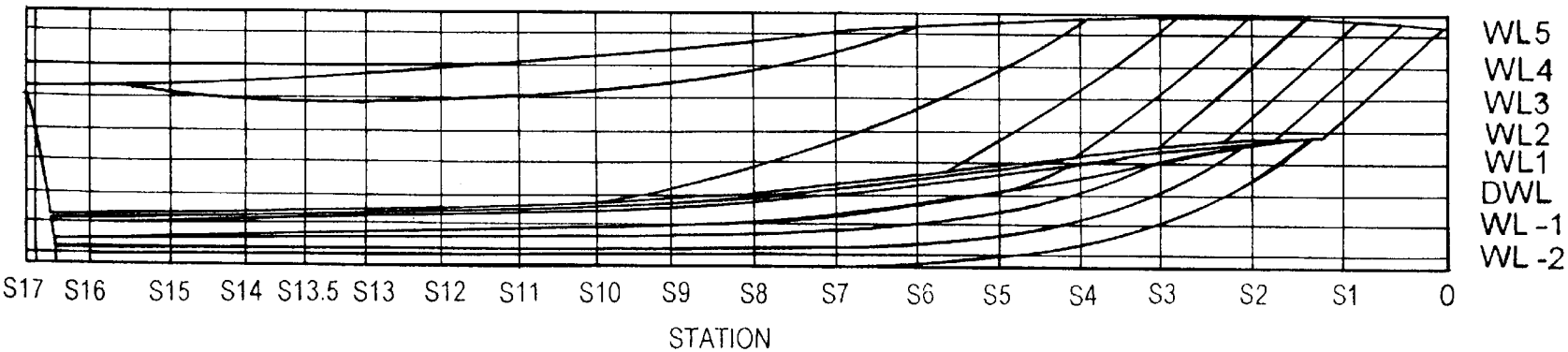
FIG. 7 is a starboard profile view, in graphical form, of the boat hull of FIG. 3 to be referenced along with Tables 1 through 19.

Exemplary dimensions for an exemplary boat hull using the principles of the present invention are outlined below, and actual offsets for a preferred embodiment are attached as Tables 1 through 19, which together provide a table of offsets, and may be referenced in conjunction with FIGS. 4, 6 and 7. In Tables 1 through 19, the offsets are given in terms of buttocks, "B", spaced at one (1') foot intervals from the centerline CL, the load water line, "LWL", or displaced water line, "DWL", also spaced at one (1') foot intervals, with respect to the water-line, and boundary edges defining connections between hard surfaces.

There are seven edges in the preferred, exemplary embodiments of the hull of the present invention, as best illustrated in FIG. 3 and FIG. 8, respectively. There is an edge at the junctures of the side of the boat and the outboard flat of bottom, at the junctures of the outboard flat of bottom and the inboard chine, at the junctures of the inboard chine and the concave centerline section, and at the juncture of the two concave centerline sections, with, as noted above, the second, exemplary embodiment of FIG. 8, also adds a convex section at the centerline CL.

Further physical properties are given in Table 20. These physical properties are valid for both embodiments shown in FIGS. 3–7 and 8, respectively.

TABLE 1

| CONTOUR FROM | DIST. FROM MIDSHIPS (FT) | OFFSET FROM CENTERLINE (FT) | HEIGHT LWL (FT) |
|---|---|---|---|
| B 1 | −19.88 | — | — |
| B 2 | −19.88 | — | — |
| B 3 | −19.88 | — | — |
| B 4 | −19.88 | — | — |
| B 5 | −19.88 | — | — |
| B 6 | −19.88 | — | — |
| B 7 | −19.88 | — | — |
| DWL | −19.88 | — | — |
| WL −2 | −19.88 | — | — |
| WL −1 | −19.88 | — | — |
| WL 0 | −19.88 | — | — |
| WL 1 | −19.88 | — | — |
| WL 2 | −19.88 | — | — |
| WL 3 | −19.88 | 6.84 | 3.00 |
| WL 4 | −19.88 | — | — |
| WL 5 | −19.88 | — | — |
| Edge 1 | −19.88 | — | — |
| Edge 2 | −19.88 | 6.90 | 3.32 |
| Edge 3 | −19.88 | 6.69 | 2.20 |
| Edge 4 | −19.88 | — | — |
| Edge 5 | −19.88 | — | — |
| Edge 6 | −19.88 | — | — |
| Edge 7 | −19.88 | — | — |

TABLE 2

| CONTOUR FROM | DIST. FROM MIDSHIPS (FT) | OFFSET FROM CENTERLINE (FT) | HEIGHT LWL (FT) |
|---|---|---|---|
| B 1 | −17.63 | 1.00 | −1.73 |
| B 2 | −17.63 | 2.00 | −1.37 |
| B 3 | −17.63 | 3.00 | −1.40 |
| B 4 | −17.63 | 4.00 | −0.98 |
| B 5 | −17.63 | 5.00 | −0.88 |
| B 6 | −17.63 | 6.00 | −0.79 |
| B 7 | −17.63 | — | — |
| DWL | −17.63 | 6.31 | 0.00 |
| WL −2 | −17.63 | 0.51 | −2.00 |
| WL −1 | −17.63 | 3.82 | −1.00 |
| WL 0 | −17.63 | 6.31 | 0.00 |
| WL 1 | −17.63 | 6.51 | 1.00 |
| WL 2 | −17.63 | 6.71 | 2.00 |
| WL 3 | −17.63 | 6.91 | 3.00 |
| WL 4 | −17.63 | — | — |
| WL 5 | −17.63 | — | |
| Edge 1 | −17.63 | 6.17 | −0.77 |
| Edge 2 | −17.63 | 6.99 | 3.38 |
| Edge 3 | −17.63 | — | — |
| Edge 4 | −17.63 | — | — |
| Edge 5 | −17.63 | 3.83 | −1.00 |
| Edge 6 | −17.63 | 0.00 | −2.34 |
| Edge 7 | −17.63 | 3.28 | −1.51 |

TABLE 3

| CONTOUR FROM | DIST. FROM MIDSHIPS (FT) | OFFSET FROM CENTERLINE (FT) | HEIGHT LWL (FT) |
|---|---|---|---|
| B 1 | −15.13 | 1.00 | −1.70 |
| B 2 | −15.13 | 2.00 | −1.34 |
| B 3 | −15.13 | 3.00 | −1.37 |
| B 4 | −15.13 | 4.00 | −0.92 |
| B 5 | −15.13 | 5.00 | −0.82 |
| B 6 | −15.13 | 6.00 | −0.73 |
| B 7 | −15.13 | 7.00 | 3.16 |
| DWL | −15.13 | 6.31 | 0.00 |
| WL −2 | −15.13 | 0.49 | −2.00 |
| WL −1 | −15.13 | 3.77 | −1.00 |
| WL 0 | −15.13 | 6.31 | 0.00 |
| WL 1 | −15.13 | 6.52 | 1.00 |
| WL 2 | −15.13 | 6.74 | 2.00 |
| WL 3 | −15.13 | 6.96 | 3.00 |
| WL 4 | −15.13 | — | — |
| WL 5 | −15.13 | — | — |
| Edge 1 | −15.13 | 6.16 | −0.72 |
| Edge 2 | −15.13 | 7.07 | 3.46 |
| Edge 3 | −15.13 | — | — |
| Edge 4 | −15.13 | — | — |
| Edge 5 | −15.13 | 3.83 | −0.94 |
| Edge 6 | −15.13 | 0.00 | −2.34 |
| Edge 7 | −15.13 | 3.28 | −1.48 |

TABLE 4

| CONTOUR FROM | DIST. FROM MIDSHIPS (FT) | OFFSET FROM CENTERLINE (FT) | HEIGHT LWL (FT) |
|---|---|---|---|
| B 1 | −12.62 | 1.00 | −1.70 |
| B 2 | −12.62 | 2.00 | −1.33 |
| B 3 | −12.62 | 3.00 | −1.34 |
| B 4 | −12.62 | 4.00 | −0.86 |
| B 5 | −12.62 | 5.00 | −0.77 |
| B 6 | −12.62 | 6.00 | −0.67 |
| B 7 | −12.62 | 7.00 | 3.01 |
| DWL | −12.62 | 6.29 | 0.00 |
| WL −2 | −12.62 | 0.49 | −2.00 |
| WL −1 | −12.62 | 3.71 | −1.00 |
| WL 0 | −12.62 | 6.29 | 0.00 |
| WL 1 | −12.62 | 6.52 | 1.00 |
| WL 2 | −12.62 | 6.76 | 2.00 |

TABLE 4-continued

| CONTOUR FROM | DIST. FROM MIDSHIPS (FT) | OFFSET FROM CENTERLINE (FT) | HEIGHT LWL (FT) |
|---|---|---|---|
| WL 3 | −12.62 | 7.00 | 3.00 |
| WL 4 | −12.62 | — | — |
| WL 5 | −12.62 | — | — |
| Edge 1 | −12.62 | 6.14 | −0.66 |
| Edge 2 | −12.62 | 7.13 | 3.56 |
| Edge 3 | −12.62 | — | — |
| Edge 4 | −12.62 | — | — |
| Edge 5 | −12.62 | 3.83 | −0.88 |
| Edge 6 | −12.62 | 0.00 | −2.34 |
| Edge 7 | −12.62 | 3.28 | −1.43 |

TABLE 5

| CONTOUR FROM | DIST. FROM MIDSHIPS (FT) | OFFSET FROM CENTERLINE (FT) | HEIGHT LWL (FT) |
|---|---|---|---|
| B 1 | −10.75 | 1.00 | −1.71 |
| B 2 | −10.75 | 2.00 | −1.33 |
| B 3 | −10.75 | 3.00 | −1.31 |
| B 4 | −10.75 | 4.00 | −0.82 |
| B 5 | −10.75 | 5.00 | −0.72 |
| B 6 | −10.75 | 6.00 | −0.63 |
| B 7 | −10.75 | 7.00 | 2.96 |
| DWL | −10.75 | 6.27 | 0.00 |
| WL −2 | −10.75 | 0.50 | −2.00 |
| WL −1 | −10.75 | 3.67 | −1.00 |
| WL 0 | −10.75 | 6.27 | 0.00 |
| WL 1 | −10.75 | 6.51 | 1.00 |
| WL 2 | −10.75 | 6.76 | 2.00 |
| WL 3 | −10.75 | 7.01 | 3.00 |
| WL 4 | −10.75 | — | — |
| WL 5 | −10.75 | — | — |
| Edge 1 | −10.75 | 6.12 | −0.62 |
| Edge 2 | −10.75 | 7.17 | 3.65 |
| Edge 3 | −10.75 | — | — |
| Edge 4 | −10.75 | — | — |
| Edge 5 | −10.75 | 3.83 | −0.83 |
| Edge 6 | −10.75 | 0.00 | −2.34 |
| Edge 7 | −10.75 | 3.28 | −1.39 |

TABLE 6

| CONTOUR FROM | DIST. FROM MIDSHIPS (FT) | OFFSET FROM CENTERLINE (FT) | HEIGHT LWL (FT) |
|---|---|---|---|
| B 1 | −8.88 | 1.00 | −1.70 |
| B 2 | −8.88 | 2.00 | −1.31 |
| B 3 | −8.88 | 3.00 | −1.28 |
| B 4 | −8.88 | 4.00 | −0.77 |
| B 5 | −8.88 | 5.00 | −0.68 |
| B 6 | −8.88 | 6.00 | −0.58 |
| B 7 | −8.88 | 7.00 | 2.94 |
| DWL | −8.88 | 6.25 | 0.00 |
| WL −2 | −8.88 | 0.49 | −2.00 |
| WL −1 | −8.88 | 3.62 | −1.00 |
| WL 0 | −8.88 | 6.25 | 0.00 |
| WL 1 | −8.88 | 6.50 | 1.00 |
| WL 2 | −8.88 | 6.76 | 2.00 |
| WL 3 | −8.88 | 7.01 | 3.00 |
| WL 4 | −8.88 | — | — |
| WL 5 | −8.88 | — | — |
| Edge 1 | −8.88 | 6.11 | −0.57 |
| Bdge 2 | −8.88 | 7.21 | 3.75 |
| Edge 3 | −8.88 | — | — |
| Edge 4 | −8.88 | — | — |
| Edge 5 | −8.88 | 3.83 | −0.79 |
| Edge 6 | −8.88 | 0.00 | −2.34 |
| Edge 7 | −8.88 | 3.28 | −1.35 |

TABLE 7

| CONTOUR FROM | DIST. FROM MIDSHIPS (FT) | OFFSET FROM CENTERLINE (FT) | HEIGHT LWL (FT) |
|---|---|---|---|
| B 1 | −6.37 | 1.00 | −1.68 |
| B 2 | −6.37 | 2.00 | −1.28 |
| B 3 | −6.37 | 3.00 | −1.22 |
| B 4 | −6.37 | 4.00 | −0.71 |
| B 5 | −6.37 | 5.00 | −0.61 |
| B 6 | −6.37 | 6.00 | −0.52 |
| B 7 | −6.37 | 7.00 | 2.97 |
| DWL | −6.37 | 6.21 | 0.00 |
| WL −2 | −6.37 | 0.47 | −2.00 |
| WL −1 | −6.37 | 3.56 | −1.00 |
| WL 0 | −6.37 | 6.21 | 0.00 |
| WL 1 | −6.37 | 6.47 | 1.00 |
| WL 2 | −6.37 | 6.74 | 2.00 |
| WL 3 | −6.37 | 7.01 | 3.00 |
| WL 4 | −6.37 | — | — |
| WL 5 | −6.37 | — | — |
| Edge 1 | −6.37 | 6.08 | −0.51 |
| Edge 2 | −6.37 | 7.26 | 3.92 |
| Edge 3 | −6.37 | — | — |
| Edge 4 | −6.37 | — | — |
| Edge 5 | −6.37 | 3.83 | −0.72 |
| Edge 6 | −6.37 | 0.00 | −2.34 |
| Edge 7 | −6.37 | 3.28 | −1.28 |

TABLE 8

| CONTOUR FROM | DIST. FROM MIDSHIPS (FT) | OFFSET FROM CENTERLINE (FT) | HEIGHT LWL (FT) |
|---|---|---|---|
| B 1 | −3.87 | 1.00 | −1.65 |
| B 2 | −3.87 | 2.00 | −1.23 |
| B 3 | −3.87 | 3.00 | −1.15 |
| B 4 | −3.87 | 4.00 | −0.64 |
| B 5 | −3.87 | 5.00 | −0.54 |
| B 6 | −3.87 | 6.00 | −0.44 |
| B 7 | −3.87 | 7.00 | 3.05 |
| DWL | −3.87 | 6.16 | 0.00 |
| WL −2 | −3.87 | 0.44 | −2.00 |
| WL −1 | −3.87 | 3.48 | −1.00 |
| WL 0 | −3.87 | 6.16 | 0.00 |
| WL 1 | −3.87 | 6.43 | 1.00 |
| WL 2 | −3.87 | 6.71 | 2.00 |
| WL 3 | −3.87 | 6.99 | 3.00 |
| WL 4 | −3.87 | 7.27 | 4.00 |
| WL 5 | −3.87 | — | — |
| Edge 1 | −3.87 | 6.05 | −0.43 |
| Edge 2 | −3.87 | 7.30 | 4.12 |
| Edge 3 | −3.87 | — | — |
| Edge 4 | −3.87 | — | — |
| Edge 5 | −3.87 | 3.83 | −0.65 |
| Edge 6 | −3.87 | 0.00 | −2.34 |
| Edge 7 | −3.87 | 3.27 | −1.19 |

TABLE 9

| CONTOUR FROM | DIST. FROM MIDSHIPS (FT) | OFFSET FROM CENTERLINE (FT) | HEIGHT LWL (FT) |
|---|---|---|---|
| B 1 | −1.38 | 1.00 | −1.61 |
| B 2 | −1.38 | 2.00 | −1.18 |
| B 3 | −1.38 | 3.00 | −1.07 |
| B 4 | −1.38 | 4.00 | −0.55 |
| B 5 | −1.38 | 5.00 | −0.44 |
| B 6 | −1.38 | 6.00 | −0.30 |
| B 7 | −1.38 | 7.00 | 3.22 |
| DWL | −1.38 | 6.08 | 0.00 |
| WL −2 | −1.38 | 0.42 | −2.00 |
| WL −1 | −1.38 | 3.37 | −1.00 |
| WL 0 | −1.38 | 6.08 | 0.00 |
| WL 1 | −1.38 | 6.36 | 1.00 |
| WL 2 | −1.38 | 6.65 | 2.00 |

TABLE 9-continued

| CONTOUR FROM | DIST. FROM MIDSHIPS (FT) | OFFSET FROM CENTERLINE (FT) | HEIGHT LWL (FT) |
|---|---|---|---|
| WL 3 | −1.38 | 6.94 | 3.00 |
| WL 4 | −1.38 | 7.23 | 4.00 |
| WL 5 | −1.38 | — | — |
| Edge 3 | −1.38 | 5.99 | −0.33 |
| Edge 4 | −1.38 | 7.33 | 4.34 |
| Edge 5 | −1.38 | — | — |
| Edge 6 | −1.38 | — | — |
| Edge 7 | −1.38 | 3.84 | −0.57 |
| Edge 10 | −1.38 | 0.00 | −2.34 |
| Edge 11 | −1.38 | 3.27 | −1.10 |

TABLE 10

| CONTOUR FROM | DIST. FROM MIDSHIPS (FT) | OFFSET FROM CENTERLINE (FT) | HEIGHT LWL (FT) |
|---|---|---|---|
| B 1 | 1.12 | 1.00 | −1.58 |
| B 2 | 1.12 | 2.00 | −1.11 |
| B 3 | 1.12 | 3.00 | −0.97 |
| B 4 | 1.12 | 4.00 | −0.42 |
| B 5 | 1.12 | 5.00 | −0.29 |
| B 6 | 1.12 | 6.00 | 0.17 |
| B 7 | 1.12 | 7.00 | 3.49 |
| DWL | 1.12 | 5.95 | 0.00 |
| WL −2 | 1.12 | 0.41 | −2.00 |
| WL −1 | 1.12 | 2.49 | −1.00 |
| WL 0 | 1.12 | 5.95 | 0.00 |
| WL 1 | 1.12 | 6.25 | 1.00 |
| WL 2 | 1.12 | 6.55 | 2.00 |
| WL 3 | 1.12 | 6.85 | 3.00 |
| WL 4 | 1.12 | 7.16 | 4.00 |
| WL 5 | 1.12 | — | — |
| Edge 1 | 1.12 | 5.90 | −0.18 |
| Edge 2 | 1.12 | 7.33 | 4.57 |
| Edge 3 | 1.12 | — | — |
| Edge 4 | 1.12 | — | — |
| Edge 5 | 1.12 | 3.83 | −0.44 |
| Edge 6 | 1.12 | 0.00 | −2.34 |
| Edge 7 | 1.12 | 3.26 | −0.98 |

TABLE 11

| CONTOUR FROM | DIST. FROM MIDSHIPS (FT) | OFFSET FROM CENTERLINE (FT) | HEIGHT LWL (FT) |
|---|---|---|---|
| B 1 | 3.79 | 1.00 | −1.56 |
| B 2 | 3.79 | 2.00 | −1.04 |
| B 3 | 3.79 | 3.00 | −0.83 |
| B 4 | 3.79 | 4.00 | −0.21 |
| B 5 | 3.79 | 5.00 | −0.07 |
| B 6 | 3.79 | 6.00 | 0.84 |
| B 7 | 3.79 | 7.00 | 3.90 |
| DWL | 3.79 | 5.51 | 0.00 |
| WL −2 | 3.79 | 0.40 | −2.00 |
| WL −1 | 3.79 | 2.12 | −1.00 |
| WL 0 | 3.79 | 5.51 | 0.00 |
| WL 1 | 3.79 | 6.05 | 1.00 |
| WL 2 | 3.79 | 6.38 | 2.00 |
| WL 3 | 3.79 | 6.70 | 3.00 |
| WL 4 | 3.79 | 7.03 | 4.00 |
| WL 5 | 3.79 | — | — |
| Edge 1 | 3.79 | 5.74 | 0.03 |
| Edge 2 | 3.79 | 7.29 | 4.80 |
| Edge 3 | 3.79 | — | — |
| Edge 4 | 3.79 | — | — |
| Edge 5 | 3.79 | 3.80 | −0.24 |
| Edge 6 | 3.79 | 0.00 | −2.33 |
| Edge 7 | 3.79 | 3.26 | −0.82 |

TABLE 12

| CONTOUR FROM | DIST. FROM MIDSHIPS (FT) | OFFSET FROM CENTERLINE (FT) | HEIGHT LWL (FT) |
|---|---|---|---|
| B 1 | 6.46 | 1.00 | −1.53 |
| B 2 | 6.46 | 2.00 | −0.95 |
| B 3 | 6.46 | 3.00 | −0.63 |
| B 4 | 6.46 | 4.00 | 0.05 |
| B 5 | 6.46 | 5.00 | 0.21 |
| B 6 | 6.46 | 6.00 | 1.68 |
| B 7 | 6.46 | 7.00 | 4.48 |
| DWL | 6.46 | 3.71 | 0.00 |
| WL −2 | 6.46 | 0.36 | −2.00 |
| WL −1 | 6.46 | 1.90 | −1.00 |
| WL 0 | 6.46 | 3.71 | 0.00 |
| WL 1 | 6.46 | 5.76 | 1.00 |
| WL 2 | 6.46 | 6.12 | 2.00 |
| WL 3 | 6.46 | 6.47 | 3.00 |
| WL 4 | 6.46 | 6.83 | 4.00 |
| WL 5 | 6.46 | 7.18 | 5.00 |
| Edge 1 | 6.46 | 5.51 | 0.29 |
| Edge 2 | 6.46 | 7.19 | 5.01 |
| Edge 3 | 6.46 | — | — |
| Edge 4 | 6.46 | — | — |
| Edge 5 | 6.46 | 3.72 | 0.01 |
| Edge 6 | 6.46 | 0.00 | −2.29 |
| Edge 7 | 6.46 | 3.24 | −0.59 |

TABLE 13

| CONTOUR FROM | DIST. FROM MIDSHIPS (FT) | OFFSET FROM CENTERLINE (FT) | HEIGHT LWL (FT) |
|---|---|---|---|
| B 1 | 9.12 | 1.00 | −1.45 |
| B 2 | 9.12 | 2.00 | −0.81 |
| B 3 | 9.12 | 3.00 | −0.33 |
| B 4 | 9.12 | 4.00 | 0.37 |
| B 5 | 9.12 | 5.00 | 0.55 |
| B 6 | 9.12 | 6.00 | 2.69 |
| B 7 | 9.12 | — | — |
| DWL | 9.12 | 3.38 | 0.00 |
| WL −2 | 9.12 | 0.26 | −2.00 |
| WL −1 | 9.12 | 1.68 | −1.00 |
| WL 0 | 9.12 | 3.38 | 0.00 |
| WL 1 | 9.12 | 5.33 | 1.00 |
| WL 2 | 9.12 | 5.73 | 2.00 |
| WL 3 | 9.12 | 6.12 | 3.00 |
| WL 4 | 9.12 | 6.52 | 4.00 |
| WL 5 | 9.12 | 6.91 | 5.00 |
| Edge 1 | 9.12 | 5.16 | 0.58 |
| Edge 2 | 9.12 | 6.99 | 5.19 |
| Edge 3 | 9.12 | — | — |
| Edge 4 | 9.12 | — | — |
| Edge 5 | 9.12 | 3.59 | 0.29 |
| Edge 6 | 9.12 | 0.00 | −2.21 |
| Edge 7 | 9.12 | 3.19 | −0.26 |

TABLE 14

| CONTOUR FROM | DIST. FROM MIDSHIPS (FT) | OFFSET FROM CENTERLINE (FT) | HEIGHT LWL (FT) |
|---|---|---|---|
| B 1 | 11.79 | 1.00 | −1.26 |
| B 2 | 11.79 | 2.00 | −0.54 |
| B 3 | 11.79 | 3.00 | 0.10 |
| B 4 | 11.79 | 4.00 | 0.74 |
| B 5 | 11.79 | 5.00 | 1.63 |
| B 6 | 11.79 | 6.00 | 3.87 |
| B 7 | 11.79 | — | — |
| DWL | 11.79 | 2.84 | 0.00 |
| WL −2 | 11.79 | 0.04 | −2.00 |
| WL −1 | 11.79 | 1.35 | −1.00 |
| WL 0 | 11.79 | 2.84 | 0.00 |
| WL 1 | 11.79 | 4.72 | 1.00 |
| WL 2 | 11.79 | 5.17 | 2.00 |

TABLE 14-continued

| CONTOUR FROM | DIST. FROM MIDSHIPS (FT) | OFFSET FROM CENTERLINE (FT) | HEIGHT LWL (FT) |
|---|---|---|---|
| WL 3 | 11.79 | 5.61 | 3.00 |
| WL 4 | 11.79 | 6.06 | 4.00 |
| WL 5 | 11.79 | 6.49 | 5.00 |
| Edge 1 | 11.79 | 4.66 | 0.89 |
| Edge 2 | 11.79 | 6.64 | 5.35 |
| Edge 3 | 11.79 | — | — |
| Edge 4 | 11.79 | — | — |
| Edge 5 | 11.79 | 3.37 | 0.60 |
| Edge 6 | 11.79 | 0.00 | −2.03 |
| Edge 7 | 11.79 | 3.07 | 0.14 |

TABLE 15

| CONTOUR FROM | DIST. FROM MIDSHIPS (FT) | OFFSET FROM CENTERLINE (FT) | HEIGHT LWL (FT) |
|---|---|---|---|
| B 1 | 14.46 | 1.00 | −0.82 |
| B 2 | 14.46 | 2.00 | −0.01 |
| B 3 | 14.46 | 3.00 | 0.94 |
| B 4 | 14.46 | 4.00 | 1.24 |
| B 5 | 14.46 | 5.00 | 3.22 |
| B 6 | 14.46 | 6.00 | 5.29 |
| B 7 | 14.46 | — | — |
| DWL | 14.46 | 2.01 | 0.00 |
| WL −2 | 14.46 | | |
| WL −1 | 14.46 | 0.79 | −1.00 |
| WL 0 | 14.46 | 2.01 | 0.00 |
| WL 1 | 14.46 | 3.24 | 1.00 |
| WL 2 | 14.46 | 4.39 | 2.00 |
| WL 3 | 14.46 | 4.89 | 3.00 |
| WL 4 | 14.46 | 5.38 | 4.00 |
| WL 5 | 14.46 | 5.86 | 5.00 |
| Edge 1 | 14.46 | 3.98 | 1.19 |
| Edge 2 | 14.46 | 6.08 | 5.46 |
| Edge 3 | 14.46 | — | — |
| Edge 4 | 14.46 | — | — |
| Edge 5 | 14.46 | 2.98 | 0.93 |
| Edge 6 | 14.46 | 0.00 | −1.67 |
| Edge 7 | 14.46 | 2.74 | 0.58 |

TABLE 16

| CONTOUR FROM | DIST. FROM MIDSHIPS (FT) | OFFSET FROM CENTERLINE (FT) | HEIGHT LWL (FT) |
|---|---|---|---|
| B 1 | 17.13 | 1.00 | 0.02 |
| B 2 | 17.13 | 2.00 | 1.01 |
| B 3 | 17.13 | 3.00 | 1.47 |
| B 4 | 17.13 | 4.00 | 3.19 |
| B 5 | 17.13 | 5.00 | 5.03 |
| B 6 | 17.13 | — | — |
| B 7 | 17.13 | — | — |
| DWL | 17.13 | 0.97 | 0.00 |
| WL −2 | 17.13 | — | — |
| WL −1 | 17.13 | — | — |
| WL 0 | 17.13 | 0.97 | 0.00 |
| WL 1 | 17.13 | 1.99 | 1.00 |
| WL 2 | 17.13 | 3.32 | 2.00 |
| WL 3 | 17.13 | 3.89 | 3.00 |
| WL 4 | 17.13 | 4.45 | 4.00 |
| WL 5 | 17.13 | 4.99 | 5.00 |
| Edge 1 | 17.13 | 2.99 | 1.46 |
| Edge 2 | 17.13 | 5.26 | 5.52 |
| Edge 3 | 17.13 | — | — |
| Edge 4 | 17.13 | — | — |
| Edge 5 | 17.13 | 2.22 | 1.28 |
| Edge 6 | 17.13 | 0.00 | −0.96 |
| Edge 7 | 17.13 | 2.04 | 1.05 |

TABLE 17

| CONTOUR FROM | DIST. FROM MIDSHIPS (FT) | OFFSET FROM CENTERLINE (FT) | HEIGHT LWL (FT) |
|---|---|---|---|
| B 1 | 20.13 | 1.00 | 1.62 |
| B 2 | 20.13 | 2.00 | 2.47 |
| B 3 | 20.13 | 3.00 | 3.94 |
| B 4 | 20.13 | — | — |
| B 5 | 20.13 | — | — |
| B 6 | 20.13 | — | — |
| B 7 | 20.13 | — | — |
| DWL | 20.13 | — | — |
| WL −2 | 20.13 | — | — |
| WL −1 | 20.13 | — | — |
| WL 0 | 20.13 | — | — |
| WL 1 | 20.13 | 0.47 | 1.00 |
| WL 2 | 20.13 | 1.66 | 2.00 |
| WL 3 | 20.13 | 2.37 | 3.00 |
| WL 4 | 20.13 | 3.04 | 4.00 |
| WL 5 | 20.13 | 3.67 | 5.00 |
| Edge 1 | 20.13 | 1.42 | 1.68 |
| Edge 2 | 20.13 | 3.98 | 5.52 |
| Edge 3 | 20.13 | — | — |
| Edge 4 | 20.13 | — | — |
| Edge 5 | 20.13 | 0.95 | 1.61 |
| Edge 6 | 20.13 | 0.00 | 0.40 |
| Edge 7 | 20.13 | 0.88 | 1.53 |

TABLE 18

| | CONTOUR FROM MIDSHIPS (FT) | DIST. FROM CENTERLINE (FT) | OFFSET FROM HEIGHT LWL (FT) |
|---|---|---|---|
| B 1 | 23.12 | 1.00 | 3.64 |
| B 2 | 23.12 | 2.00 | 4.98 |
| B 3 | 23.12 | — | — |
| B 4 | 23.12 | — | — |
| B 5 | 23.12 | — | — |
| B 6 | 23.12 | — | — |
| B 7 | 23.12 | — | — |
| DWL | 23.12 | — | — |
| WL −2 | 23.12 | — | — |
| WL −1 | 23.12 | — | — |
| WL 0 | 23.12 | — | — |
| WL 1 | 23.12 | — | — |
| WL 2 | 23.12 | — | — |
| WL 3 | 23.12 | 0.50 | 3.00 |
| WL 4 | 23.12 | 1.28 | 4.00 |
| WL 5 | 23.12 | 2.02 | 5.00 |
| Edge 1 | 23.12 | — | — |
| Edge 2 | 23.12 | 2.33 | 5.45 |
| Edge 3 | 23.12 | — | — |
| Edge 4 | 23.12 | 0.00 | 2.38 |
| Edge 5 | 23.12 | — | — |
| Edge 6 | 23.12 | — | — |
| Edge 7 | 23.12 | — | — |

TABLE 19

| | CONTOUR FROM MIDSHIPS (FT) | DIST. FROM CENTERLINE (FT) | OFFSET FROM HEIGHT LWL (FT) |
|---|---|---|---|
| B 1 | 26.62 | — | — |
| B 2 | 26.62 | — | — |
| B 3 | 26.62 | — | — |
| B 4 | 26.62 | — | — |
| B 5 | 26.62 | — | — |
| B 6 | 26.62 | — | — |
| B 7 | 26.62 | — | — |
| DWL | 26.62 | — | — |
| WL −2 | 26.62 | — | — |
| WL −1 | 26.62 | — | — |
| WL 0 | 26.62 | — | — |

TABLE 19-continued

| | CONTOUR FROM MIDSHIPS (FT) | DIST. FROM CENTERLINE (FT) | OFFSET FROM HEIGHT LWL (FT) |
|---|---|---|---|
| WL 1 | 26.62 | — | — |
| WL 2 | 26.62 | — | — |
| WL 3 | 26.62 | — | — |
| WL 4 | 26.62 | — | — |
| WL 5 | 26.62 | — | — |
| Edge 1 | 26.62 | — | — |
| Edge 2 | 26.62 | — | — |
| Edge 3 | 26.62 | — | — |
| Edge 4 | 26.62 | — | — |
| Edge 5 | 26.62 | — | — |
| Edge 6 | 26.62 | — | — |
| Edge 7 | 26.62 | — | — |

TABLE 20

| | |
|---|---|
| Weight (pound) | 24,197 lb |
| Draft Amidship (feet) | 2.428 ft |
| Displacement (feet) | 24,190 ft |
| Heel (deg) | 0° |
| Trim (feet) | 2.078 ft forward |
| Water Line Length (feet) | 40.755 ft |
| Water Line Beam (feet) | 12.324 ft |
| Wetted Area (square feet) | 470.152 $ft^2$ |
| Waterplane Area (square feet) | 401.203 $ft^2$ |
| MTi Long (tons/feet) | 2.493 |
| TPi Long (tons/inch) | 0.955 |
| GM longitudinal (feet) | 107.350 ft |
| GM transverse (feet) | 10.708 ft |
| Longitudinal Center of Flotation to Amidship (feet) | 2.181 ft Aft |
| Longitudinal Center of Buoyancy to Amidship (feet) | 0.030 ft Forward |
| Waterplane Area Coefficient | 0.799 |
| Midship Area Coefficient | 0.434 |
| Block Coefficient | 0.268 |
| Prismatic Coefficient | 0.696 |

As should be understood from the foregoing portion of this specification and tables, the boat bottom hulls of the exemplary embodiments have a much deeper, transverse step, for example, by an exemplary factor of roughly about four-to-one (~4:1), than the prior art, to more effectively exploit the potential advantages of internal chines and lifting strakes. For example, the stepped inboard chine A for a forty (40') foot hull could, in accordance with the invention, have a vertical depth of at least about nine (9") at its deepest area [versus an exemplary prior art vertical size of about two to three (2–3") inches, roughly a factor of three to four-and-a-half to one (~3–4.5:1)] in vertical depths.

Thus, in comparison to the prior art, which has for its step for the type of planing hull involved in the invention, a maximum depth (measured in the vertical) of about two to three (2–3%) percent of the over-all boat depth, as measured vertically from the main deck line vertically down to the keel, the preferred designs of the invention for the step A have a minimum depth (measured vertically) of about nine to ten (9–10%) percent of the boat depth along the major aft portion of the hull, which is typically about two-thirds of the over-all hull length, namely, from about S6 through S17 (note FIG. 6), that is, along the hull length where the step A if fully developed. Thus, in comparing the invention to the prior art, there preferably is a difference in factor ratio in a range of about three through five to one (3–5:1), namely comparing three (3%) percent to nine (9%) percent (9:3=3:1) and two (2%) percent to ten (10%) percent (10:2=5:1), respectively.

Figure 1:
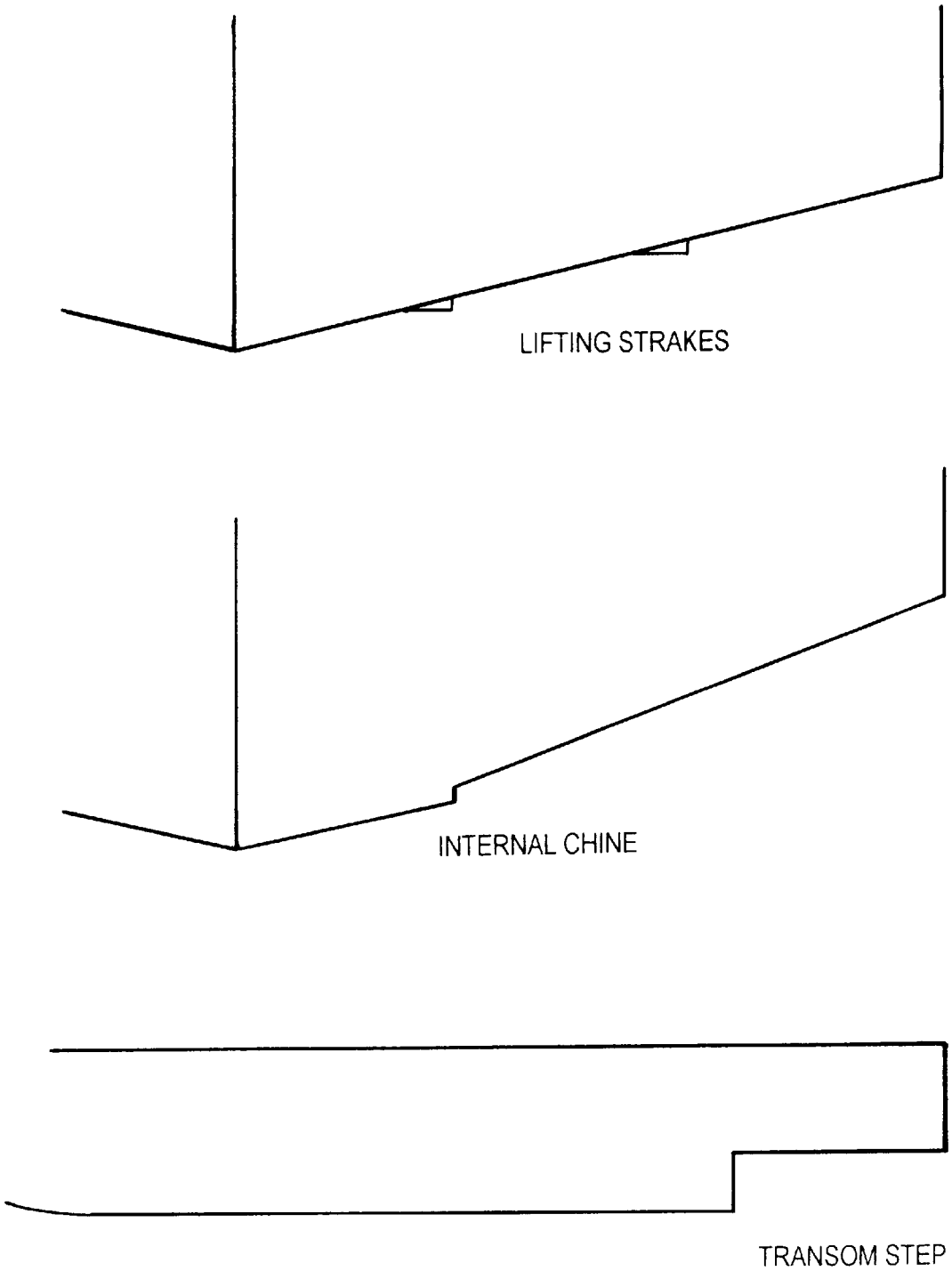
FIGURE 1 PRIOR ART
FIG. 1 is a lateral, partial, simplified, cross-section view of three, exemplary, prior art hull designs, showing the prior art use of, from top to bottom, lifting strakes, internal chine and transom step, each of which has the deficiencies of the prior art noted herein, particularly that illustrated in FIG. 2.
Figure 2:
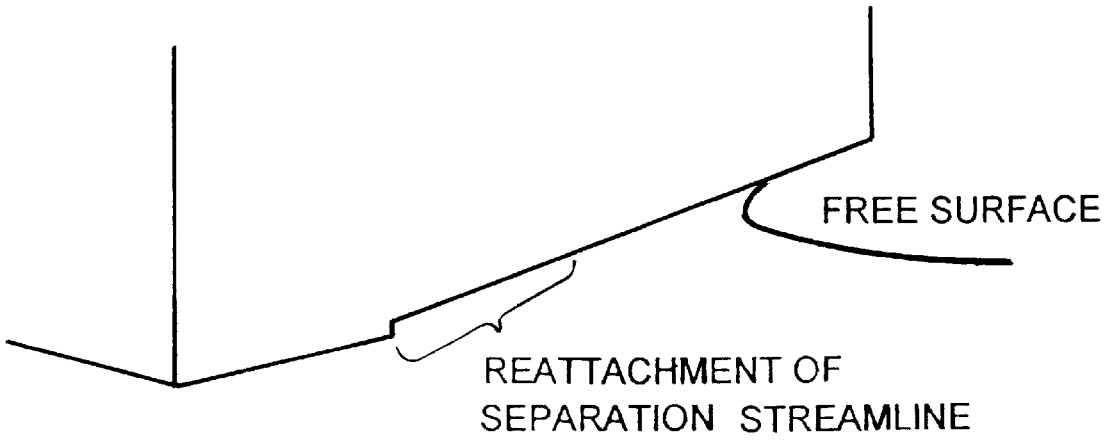
FIGURE 2 PRIOR ART
FIG. 2 is a lateral, partial, simplified, cross-sectional view of the internal chine hull design approach of the prior art, comparable to the mid-hull design of FIG. 1, showing the undesired or unwanted "flow reattachment" problem of the prior art designs, with the phenomenon being analogously the same for the top and bottom prior art hull designs of FIG. 1.

Hence, the transverse depth of the stepped inboard chine A, located between the concave centerline section B and the outboard flat of the bottom C is far greater than that of the prior art, representing a difference in kind rather than merely one of degree, unexpectedly resulting in the avoidance of the prior art problem illustrated in FIG. 2. Accordingly, the hull bottom has a much deeper transverse step A than the prior art, which allows it to effectively achieve a bi-modal hull form—displacement and planing—and in particular avoids the prior art problem of water flow reattachment in the outboard flat area (in the analogous area of C) illustrated in FIG. 2.

Thus, the exemplary, two hull forms of FIGS. 1–7 and 8 consistently achieve and maintain the flow separation needed to assure the relatively low surface area needed for minimum planing resistance and minimum sea wave impact acceleration, avoiding the problem illustrated for the prior art in FIG. 2.

In addition, it should be understood that the hull bottom's concave curvature (note area B of FIG. 3 and area B1 of FIG. 8) of the narrow planing region of the hull, which begins from the initiation of the step A, namely, just aft of section line S1 (note FIG. 6), back to the stern of the hull, shifts the center of dynamic pressure forward and provides a more balanced acceleration, with less extreme boat attitudes, in the transition from displacement to planing mode, as well as when operating at steady speeds over the entire speed range.

It is noted that the embodiments described herein in detail for exemplary purposes are of course subject to many different variations in structure, design, application and methodology. Because many varying and different embodiments may be made within the scope of the inventive concepts herein taught, and because many modifications may be made in the embodiments herein detailed in accordance with the descriptive requirements of the law, it is to be understood that the details herein are to be interpreted as illustrative and not in a limiting sense.

What is claimed is:

1. A boat hull bottom, having a center-line which forms the very bottom of the hull and further having:

a longitudinally extending, transverse step having a minimum, vertical, transverse step depth of about nine (9%) percent of the over-all hull boat depth along the major aft portion of the boat hull bottom;

the hull also including a narrow planing region and further having:

a longitudinally extending, concave curvature located in the narrow planing region of the hull which shifts the center of dynamic pressure forward and provides a more balanced acceleration, with less extreme boat attitudes, in the transition from displacement to planing mode, as well as when operating at steady speeds over the entire speed range of the hull bottom.

2. A boat hull bottom, having a center-line which forms the very bottom of the hull and further having:

a longitudinally extending, transverse step having a minimum, vertical, transverse step depth of about nine (9%) percent of the over-all hull boat depth along the major aft portion of the boat hull bottom;

said longitudinally extending step being located between a flat outboard area and a curved centerline area on each side of the hull bottom.

3. The boat hull bottom of claim 2, wherein said deeper transverse step has:

a vertical depth of at least about nine (9") inches at its deepest area along the over-all hull length.

4. A boat hull bottom, having a center-line which forms the very bottom of the hull and further having:

a longitudinally extending, transverse step having a vertical depth of at least about nine (9") inches at its deepest area along the over-all hull bottom length;

the hull also including a narrow planing region and further having:

a longitudinally extending, concave curvature located in the narrow planing region of the hull which shifts the center of dynamic pressure forward and provides a more balanced acceleration, with less extreme boat attitudes, in the transition from displacement to planing mode, as well as when operating at steady speeds over the entire speed range of the hull bottom.

5. A boat hull bottom, having a center-line which forms the very bottom of the hull and further having:

a longitudinally extending, transverse step having a vertical depth of at least about nine (9") inches at its deepest area along the over-all hull bottom length;

said longitudinally extending step being located between a flat outboard area and a curved centerline area on each side of the hull bottom.

6. The boat hull bottom of claim 5, wherein said deeper transverse step has:

a minimum, vertical, transverse step depth of about nine (9%) percent of the over-all hull boat depth along the major aft portion of the boat hull bottom.

* * * * *